US009016597B2

(12) United States Patent
Hsieh

(10) Patent No.: US 9,016,597 B2
(45) Date of Patent: Apr. 28, 2015

(54) OSCILLATING SPRINKLER WITH TOGGLE VALVE

(75) Inventor: Pai-Chou Hsieh, Ho-Ming Village (TW)

(73) Assignee: Yuan Pin Industrial Co., Ltd., Chang-Hua County (TW)

( * ) Notice: Subject to any disclaimer, the term of this patent is extended or adjusted under 35 U.S.C. 154(b) by 447 days.

(21) Appl. No.: 13/610,970

(22) Filed: Sep. 12, 2012

(65) Prior Publication Data

US 2014/0070023 A1 Mar. 13, 2014

(51) Int. Cl.

| | |
|---|---|
| ***B05B 3/00*** | (2006.01) |
| ***B05B 3/16*** | (2006.01) |
| ***B05B 15/06*** | (2006.01) |
| ***B05B 3/04*** | (2006.01) |

(52) U.S. Cl.

CPC . *B05B 3/16* (2013.01); *B05B 3/045* (2013.01); *B05B 3/0431* (2013.01); *B05B 3/0436* (2013.01); *B05B 3/044* (2013.01); *B05B 3/0409* (2013.01); *B05B 3/0418* (2013.01)

(58) Field of Classification Search

CPC .... B05B 3/0431; B05B 3/0436; B05B 3/044; B05B 3/045

USPC ..... 239/200, 201, 210, 242, 263.3, 394, 239/577; 137/625.11, 625.44

See application file for complete search history.

(56) References Cited

U.S. PATENT DOCUMENTS

| | | | | |
|---|---|---|---|---|
| 3,630,450 | A * | 12/1971 | Stephany et al. | 239/242 |
| 7,014,128 | B2 * | 3/2006 | Leung | 239/461 |
| 2007/0119978 | A1 * | 5/2007 | Wang et al. | 239/242 |

FOREIGN PATENT DOCUMENTS

| | | | | |
|---|---|---|---|---|
| EP | 826427 | A2 * | 3/1998 | B05B 3/16 |

* cited by examiner

*Primary Examiner* — Len Tran
*Assistant Examiner* — Alexander Valvis
(74) *Attorney, Agent, or Firm* — Alan D. Kamrath; Kamrath IP Lawfirm, P.A.

(57) ABSTRACT

An oscillating sprinkler includes a rotatable cylindrical mount, an impeller housing at one side of the rotatable body, an impeller in the impeller housing, a pair of sweep setting rings at the other side of the rotatable body, and a toggle valve in the rotatable body. The impeller housing has an outlet wall defines two impeller inlets therein. Each of the sweep setting rings has a radial wall provided with an arcuate slot. The rotatable body has a radial inlet wall provided with an aperture. The toggle valve is configured to control which of the impeller inlets in the outlet wall is opened. The toggle valve includes a rocker, a lever, an arm extending the lever and through the aperture in the inlet wall and the slots in the sweep setting rings and a snap bushing sleeved on the arm and having fingers snapped in a groove of the arm.

5 Claims, 6 Drawing Sheets

OSCILLATING SPRINKLER WITH TOGGLE VALVE

BACKGROUND OF THE INVENTION

1. Field of the Invention

The present invention relates to an oscillating sprinkler for use in irrigating lawns, flowers, shrubs and the like, and more particularly to an oscillating sprinkler with a toggle valve.

2. Description of the Related Art

Oscillating sprinklers have long been known and used in the irrigation art for watering lawns, gardens, shrubs, flowers and other plants. Typically, such sprinklers include a water-driven motor mounted in a housing and which drives an elongated spray tube for side-to-side oscillation about a generally horizontal axis.

FIG. 6 illustrates a conventional oscillating sprinkler which includes generally a spray bar (not shown) and an impeller assembly 9 which is driven by the flow of incoming water to the sprinkler and drives the spray bar for oscillating movement. The impeller assembly 9 includes an impeller (not shown) and a reduction gear train 97. The incoming water flow drives the impeller which, through the reduction gear train 97, applies an oscillating motion to the spray bar which has nozzles from which the water is delivered. Specifically, water entering the impeller assembly 9 of the sprinkler passes into a central tube 99 and then into an inlet chamber 95 in the impeller assembly 9 where it passes into one or other of two impeller inlets 91, 92, depending on the condition of a toggle valve 96.

The toggle valve 96 has a rocker member 93 from which projects a lever surrounded by a helical spring 94. The lever is extended to form a switching arm 98. By pushing the arm 98 in one direction the rocker member 93 is moved to the position illustrated in FIG. 6 in which the inlet 91 is open to enable water to enter the inlet 91 whilst the inlet 92 is blocked by the member 93. On the contrary, when the arm 98 is pushed in the opposite direction, the rocker member 93 moves over center to the alternative (non-illustrated) position, in which the inlet 92 is open for the passage of water and the inlet 91 is closed. Movement of the arm 98 is affected by two sweep setting rings (not shown) mounted for independent rotational adjusting movement about the central longitudinal axis of the sprinkler. Each ring has a radial wall provided with an arcuate slot through which the aim 98 extends, and the edge of each slot is capable of being engaged by the arm 98 to cause change-over of the rocker member 93.

When water reaches the impeller through the inlet 91, the water flow drives the impeller in one rotational direction and when water reaches the impeller through the inlet 92 the water flow drives the impeller in the other rotational direction. The impeller is linked to the gear train 97, the result being that the whole of the impeller assembly 9 and the spray bar oscillate, about a stationary gear (not shown) carried by the central tube 99, through an angular displacement determined by the setting of the sweep setting rings.

In this sprinkler, the movement of the rocker member 93 is affected by the helical spring 94 and the switching arm 98. When the arm 98 is pushed, a torque is built on the spring 94 to have the rocker member 93 switched. However, when the water pressure is high, the torque produced by the spring may not be easily concentrated or dispersed to switch the rocker member 93, which may finally cause a failure of the toggle valve 96.

SUMMARY OF THE INVENTION

According to the invention an oscillating sprinkler comprises a rotatable cylindrical body, an impeller housing at a top of the rotatable body, an impeller disposed in the impeller housing, a pair of sweep setting rings and a toggle valve substantially disposed in the rotatable body. The rotatable cylindrical body has a radial inlet wall provided with an aperture and a pair of trunnion saddles disposed on a top of the inlet wall and at opposite sides of the aperture. The impeller housing has an outlet wall opposite to the inlet wall of the rotatable body and a pair of trunnion seats disposed on a bottom of the outlet wall. The outlet wall of the impeller housing defines two impeller inlets therein with inward slant end facets respectively. The trunnion seats are arranged in a line normal to that of the impeller inlets of the outlet wall.

The sweep setting rings are disposed underneath the inlet wall of the rotatable body, and each has a radial wall provided with an arcuate slot. The toggle valve is configured to control which of the two impeller inlets in the outlet wall of the impeller housing is opened. Specifically, the toggle valve includes a rocker, a switching member, a seal ring and a snap member. The rocker has a pair of slant cover plates disposed in an inverted V-shaped manner and corresponding to the inward slant end facets of the impeller inlets in the outlet wall for covering either one of the two impeller inlets. The rocker also has a pair of trunnions which are disposed on opposite sides of a junction formed between the two slant cover plates and rested on the trunnion seats of the impeller housing.

The switching member includes a lever, a push plate, an arm and a pair of trunnions. The lever is disposed in the rotatable body. The push plate extends from one end of the lever and is normal to the lever. The arm extends from the other end of the lever and through the aperture in the inlet wall of the rotatable body as well as the arcuate slots of the sweep setting rings. The trunnions extend from opposite sides of the lever and rested on the trunnion saddles of the rotatable body. The seal ring is sleeved on the lever and seals the aperture in the inlet wall of the rotatable body. The snap bushing is disposed underneath a bottom of the inlet wall of the rotatable body, sleeved on the arm of the switching member and having fingers snapped in a groove of the arm.

By using no helical springs for change-over of the rocker member as illustrated in the prior art, the present invention ensures that its toggle valve functions well even if the water pressure is high in the sprinkler. Further benefits and advantages of the present invention will become apparent after a careful reading of the detailed description with appropriate reference to the accompanying drawings.

BRIEF DESCRIPTION OF THE DRAWINGS

An oscillating sprinkler according to the invention will now be described, by way of example, with reference to the accompanying drawings, in which.

DETAILED DESCRIPTION OF EMBODIMENTS

Figure 1:
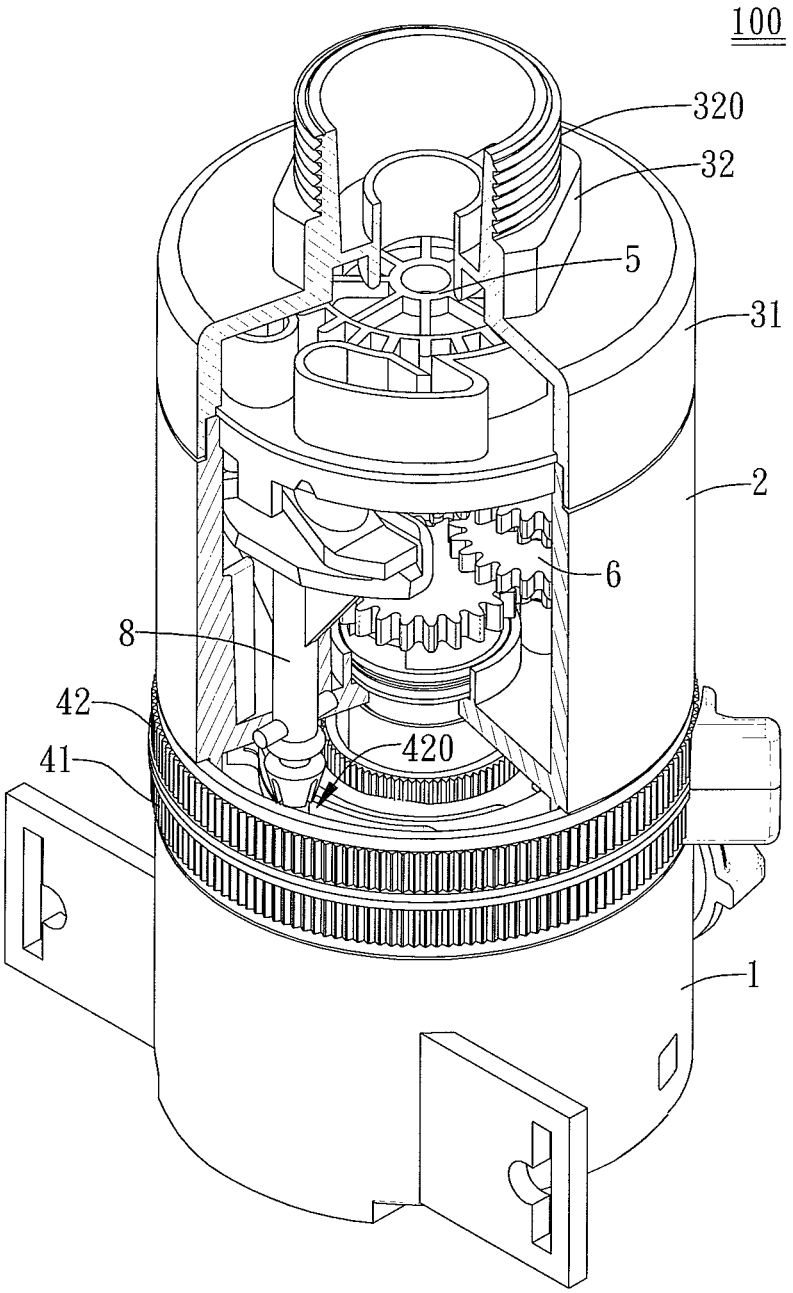
FIG. 1 is an isometric view of the sprinkler, and with parts cut away, to show internal detail.
Figure 2:
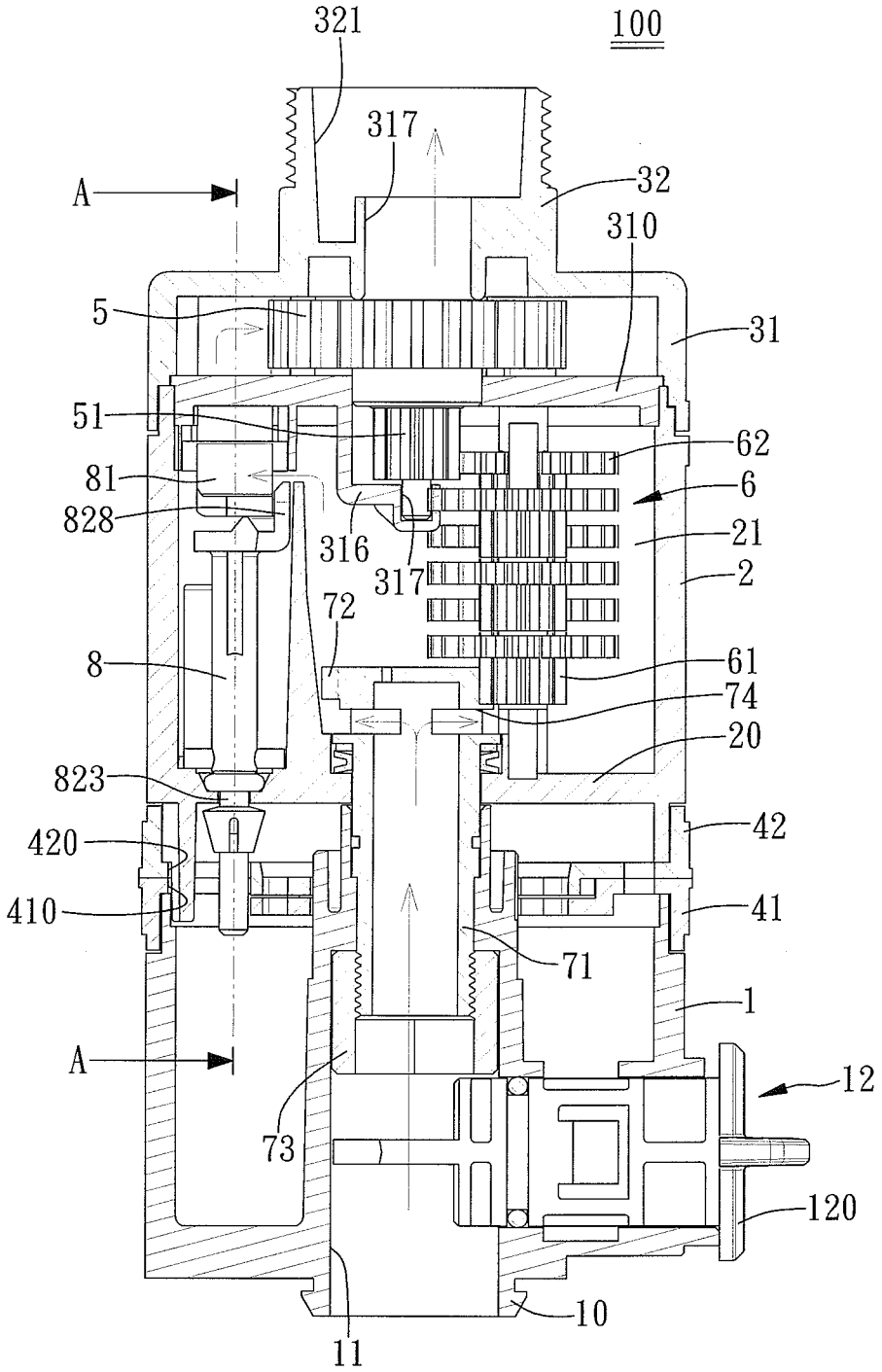
FIG. 2 is a longitudinal sectional view of the sprinkler.

Referring to FIGS. 1 and 2, the sprinkler 100 comprises an inlet portion 1, a rotatable cylindrical body 2, a pair of sweep setting rings 41, 42 between the inlet portion 1 and the body 2, an impeller housing 31, an outlet portion 32 extending from the impeller housing 31, and an impeller assembly disposed therein. The outlet portion 32 has an outlet coupling 320 for connection of a spray head or bar (not shown). The inlet portion 1 includes an inlet coupling 10 for connection of a hose fitting, enabling water to be supplied to an inlet conduit 11 defined in the inlet portion 1. The impeller assembly includes an impeller 5 disposed in the impeller housing 31, a reduction gear train 6 disposed in the rotatable body 2, a central tube 71, a stationary gear wheel 72 coaxially carried by the central tube 71 and a toggle valve 8 substantially disposed in the rotatable body 2.

As shown in FIG. 2, the pair of sweep setting rings 41, 42 is disposed underneath a radial inlet wall 20 of the rotatable body 2. Each of the rings 41, 42 has a radial wall provided with an arcuate slot 410 or 420. The central tube 71 extends through the sweep setting rings 41, 42 as well as the inlet wall 20 of the rotatable body 2. The central tube 71 has one end secured to the inlet portion 1 by means of a nut 73. In addition, a flow control valve 12 is included in the sprinkler 100 and substantially embedded in the inlet portion 1 for controlling flow of water through the inlet conduit 11 and into the central tube 71, and has an externally accessible portion 120 for manual adjustment of the flow control valve 12.

Figure 3:
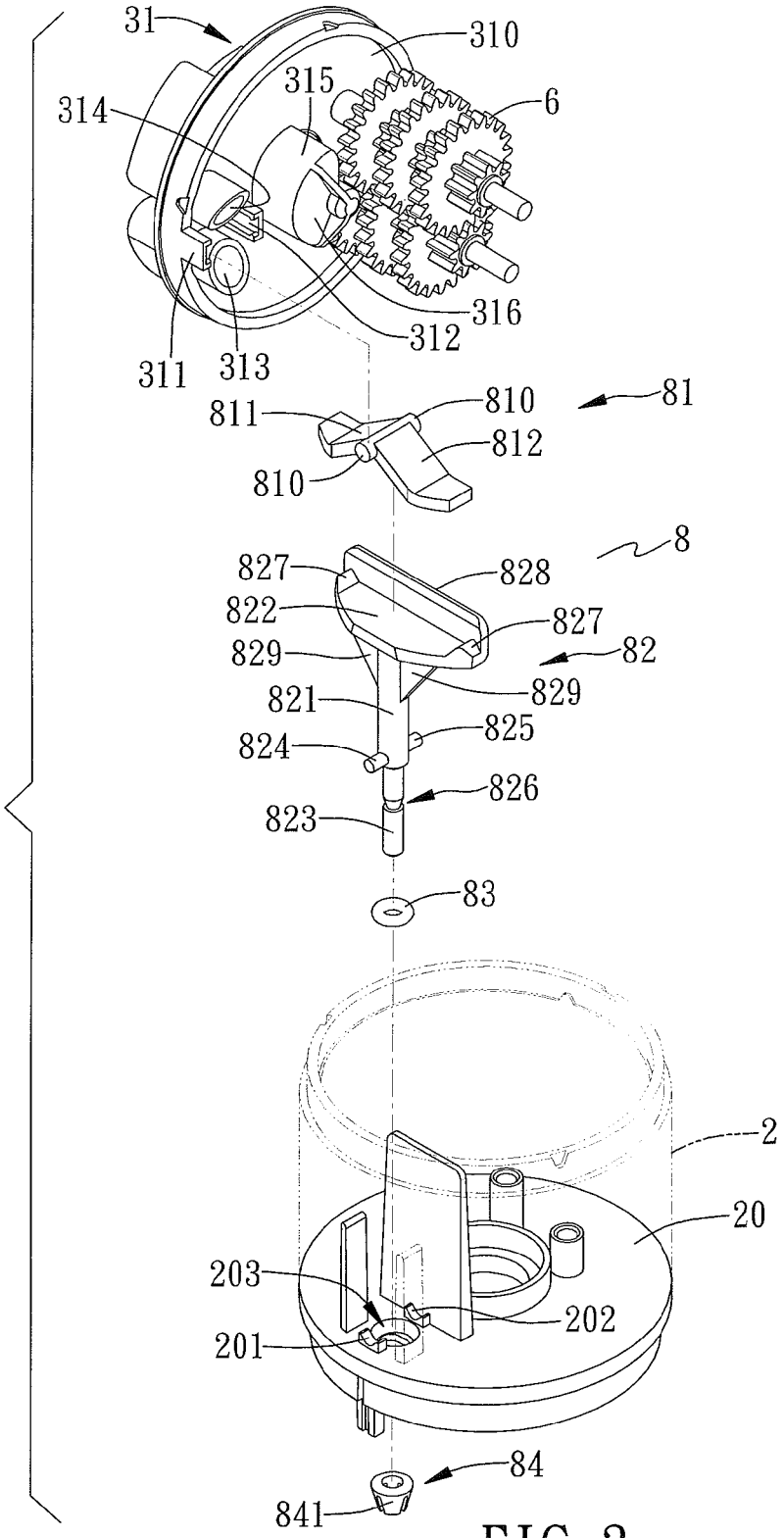
FIG. 3 is a fragmentary exploded view of the sprinkler.
Figure 4:
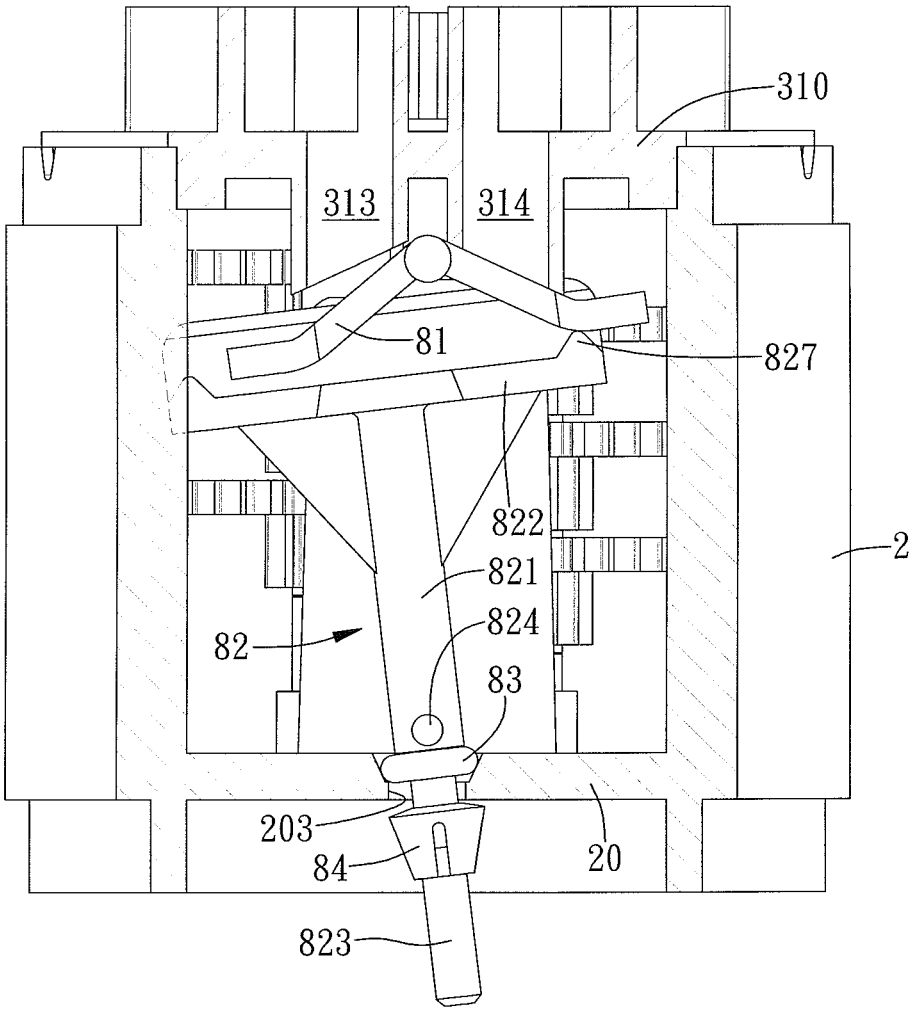
FIG. 4 is a cross section view taken along line A-A of FIG. 2, showing one of two impeller inlets is opened.
Figure 5:
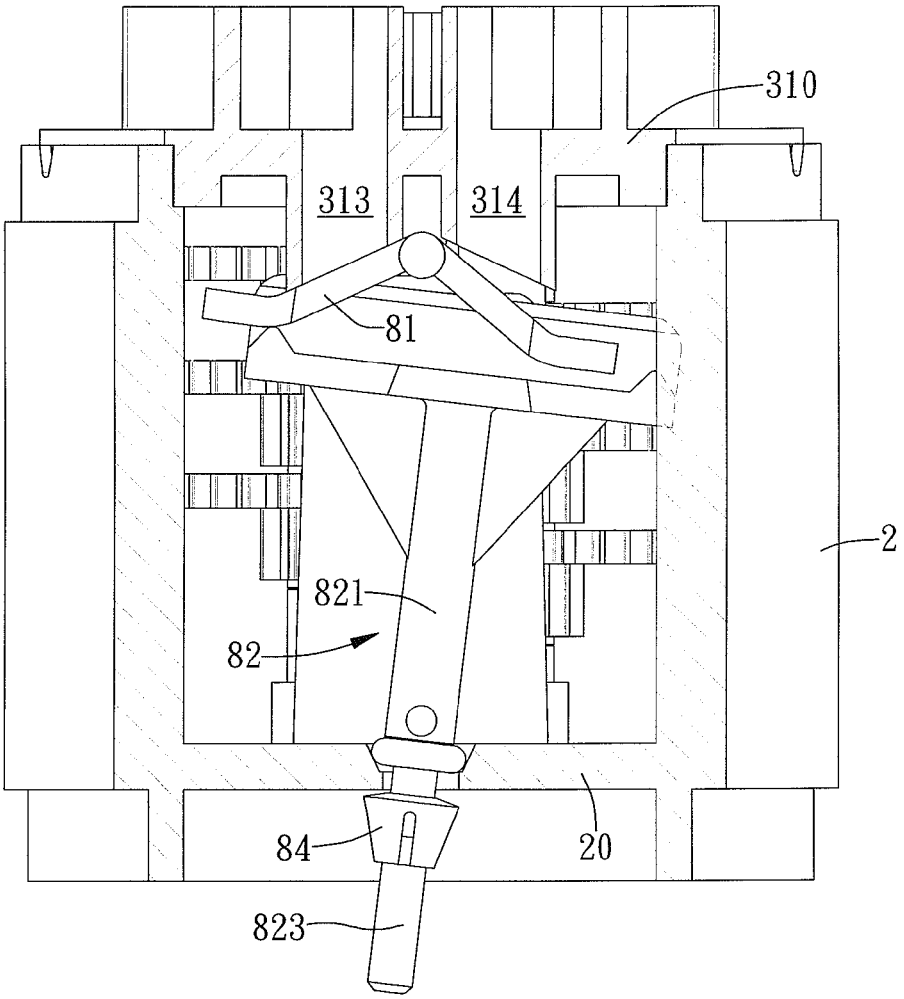
FIG. 5 is a view similar to FIG. 4 showing the other impeller inlet is opened.

As shown in FIG. 3, the rotatable cylindrical body 2 has an aperture 203 defined in the inlet wall 20 and a pair of trunnion saddles 201, 202 disposed on a top of the inlet wall 20. The trunnion saddles 201, 202 are arranged at opposite sides of the aperture 203 in the inlet wall 20. On the other hand, the impeller housing 31 has an outlet wall 310 opposite to the inlet wall 20 of the rotatable body 2. The impeller housing 31 further includes a pair of trunnion seats 311, 312 disposed on a bottom of the outlet wall 310. The outlet wall 310 defines two impeller inlets 313, 314 therein with inward slant end facets, as depicted in FIG. 3, 4 or 5. The trunnion seats 311, 312 are arranged in a line normal to that of the impeller inlets 313, 314. Furthermore, the impeller housing 31 is formed at the bottom of the outlet wall 310 with a half-cylindrical shell 315 which has a radial wall 316. Referring to FIG. 2, the radial wall 316 is provided with a receptacle 317 coaxial to a drive gear 51 of the impeller 5 for reception of a distal end of a spindle of the drive gear 51 of the impeller 5. In this way, the spindle of the impeller 5 may be well positioned and supported so that the impeller 5 can keep stable while in motion, especially for driving the reduction gear train 6.

The reduction gear train 6 is disposed in the rotatable body 2 with a lower gear 61 meshing with the stationary gear wheel 72 carried by the central tube 71 and an upper gear 62 meshing with the drive gear 51 of the impeller 5. In such a manner, the impeller 5 is linked to the gear train 6 so that the whole impeller housing 31 and the rotatable body 2 can oscillate about the stationary gear wheel 72, through an angular displacement determined by the setting of the sweep setting rings 41, 42, as will be described in detail later As best shown in FIG. 2, water entering the sprinkler 100, under the control of the valve 12, passes through the inlet conduit 11 in the inlet portion 1 and into the central tube 71, through a pair of opposed openings 74 in the wall of the tube 71 and thence into an inlet chamber 21 in the body 2 where it passes into one or other of the two impeller inlets 313, 314, depending on the condition of the toggle valve 8.

Referring to FIG. 3, the toggle valve 8 is substantially disposed in the rotatable body 2 and configured to control which of the two impeller inlets 313, 314 in the outlet wall 310 of the impeller housing 31 is opened. Specifically, the toggle valve 8 includes a rocker 81, a switching member 82, a seal ring 83 and a snap bushing 84. The rocker 81 has a pair of slant cover plates 811, 812 disposed in an inverted V-shaped manner and corresponding to the inward slant end facets of the impeller inlets 313, 314 in the outlet wall 310 for covering either one of the two impeller inlets 313, 314. The rocker 81 further has a pair of trunnions 810 which are disposed on opposite sides of a junction formed between the two slant cover plates 811, 812 and rested on the trunnion seats 311, 312 of the impeller housing 31. In this way, the rocker 81 can swing back and forth on the trunnion seats 311, 312 about the centerline of the trunnions 810.

The switching member 82 includes a lever 821 disposed in the rotatable body 2, a push plate 822 extending from one end of the lever 821 and being normal to the lever 821 and an arm 823 extending from the other end of the lever 821. Referring to FIGS. 2 and 3, the arm 823 of the switching member 82 runs through the aperture 203 in the inlet wall 20 of the rotatable body 2 as well as the arcuate slots 410, 420 of the sweep setting rings 41, 42. The switching member 82 further includes a pair of trunnions 824, 825 extending from opposite sides of the lever 821 and rested on the trunnion saddles 201, 202 of the rotatable body 2. Gusset plates 829 may be included in between the lever 821 and the push plate 822 for strengthening.

As best seen in FIG. 4, the seal ring 83 is sleeved on the lever 83 to seal the aperture 203 in the inlet wall 20 of the rotatable body 2. The snap bushing 84 is disposed underneath a bottom of the inlet wall 20 of the rotatable body 2, sleeved on the arm 823 and has fingers 841 snapped in a groove 826 defined in the arm 823, as depicted in FIG. 3. Preferably, the push plate 822 may be formed on its top with two bumps 827 corresponding to the two slant cover plates 811, 812 of the rocker 81 to assist in pushing against the latter. Moreover, the push plate 822 may also be formed at its edge an upright shield 828 abutting against a side edge of the rocker 81, as illustrated in FIG. 2, so as to ensure that the rocker 81 is constrained to swing back and forth in a plane.

Referring to FIGS. 1 and 2, movement of the arm 823 of the switching member 82 is affected by the two sweep setting rings 41, 42 mounted for independent rotational adjusting movement about the central longitudinal axis of the sprinkler 100 and with respect to the inlet portion 1. The edge of each aperture 410, 420 of the swing setting rings 41, 42 is capable of being engaged by the arm 823 to cause change-over of the whole switching member 82 and the rocker 81.

Figure 6:
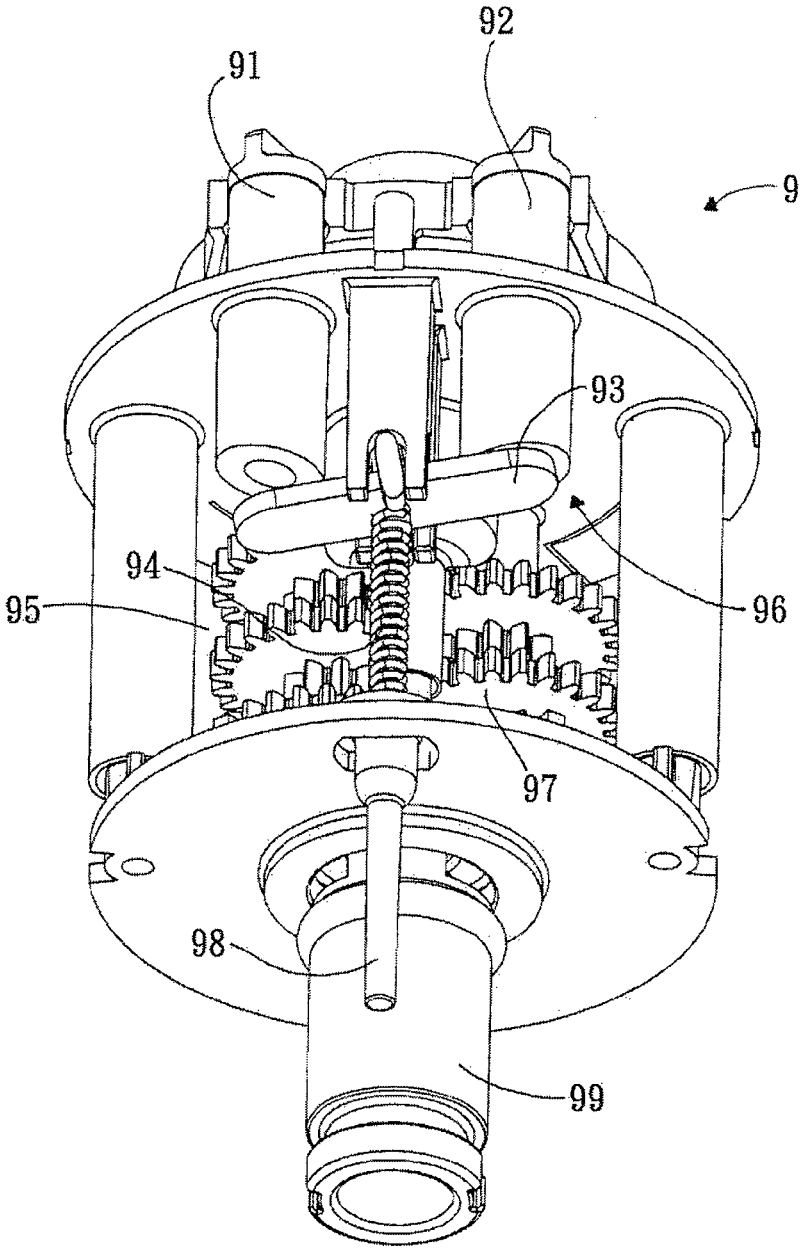
FIG. 6 PRIOR ART
FIG. 6 is a prior art.

By pushing the arm 823 in one direction, the switching member 82 and the rocker 81 are moved to the position illustrated in FIG. 4 in which the impeller inlet 313 is open to enable water to enter the inlet 313 whilst the inlet 314 is blocked by the rocker 81. When the arm 823 is pushed in the opposite direction, the lever 821 moves over center to the alternative position illustrated in FIG. 5, in which the inlet 314 is open for the passage of water and the inlet 313 is closed. By using no helical springs 94 (FIG. 6) for change-over of the rocker member 93 as illustrated in the prior art, the present invention ensures that its toggle valve 8 functions well even if the water pressure is high in the sprinkler 100.

Afterward, when water reaches the impeller 5 through the inlet 313, the water flow drives the impeller 5 in one rotational direction and when water reaches the impeller 5 through the inlet 314 the water flow drives the impeller 5 in the other rotational direction. The impeller 5 is linked to the reduction gear train 6, the result being that the whole of the impeller housing 32 and the body 2 oscillate, about the stationary gear wheel 72 carried by the central tube 71, through an angular displacement determined by the setting of the sweep setting rings 41, 42. After driving the impeller 5, the water enters an impeller outlet chamber 317 and through an outlet conduit 321 in the outlet portion 32.

It is to be understood that the disclosed embodiments are illustrative in nature and the invention is not to be limited to any one or more embodiments except as set forth in the following claims.

What is claimed is:

1. An oscillating sprinkler, comprising:

a rotatable cylindrical body having a radial inlet wall provided with an aperture and a pair of trunnion saddles disposed on a top of the inlet wall and at opposite sides of the aperture;

an impeller housing having an outlet wall opposite to the inlet wall of the rotatable body and a pair of trunnion seats disposed on a bottom of the outlet wall; the outlet wall defining two impeller inlets therein with inward slant end facets respectively; and the trunnion seats being arranged in a line normal to that of the impeller inlets;

an impeller disposed in the impeller housing;

a pair of sweep setting rings disposed underneath the inlet wall of the rotatable body, and each having a radial wall provided with an arcuate slot; and a toggle valve substantially disposed in the rotatable body and configured to control which of the two impeller inlets in the outlet wall of the impeller housing is opened; and wherein the toggle valve comprises:

a rocker having a pair of slant cover plates disposed in an inverted V-shaped manner and corresponding to the inward slant end facets of the impeller inlets in the outlet wall for covering either one of the two impeller inlets, and a pair of trunnions which are disposed on opposite sides of a junction formed between the two slant cover plates and rested on the trunnion seats of the impeller housing;

a switching member including a lever disposed in the rotatable body, a push plate extending from one end of the lever and being normal to the lever, an arm extending from the other end of the lever and through the aperture in the inlet wall of the rotatable body and the arcuate slots of the sweep setting rings, and a pair of trunnions extending from opposite sides of the lever and rested on the trunnion saddles of the rotatable body;

a seal ring sleeved on the lever and sealing the aperture in the inlet wall of the rotatable body; and a snap bushing disposed underneath a bottom of the inlet wall of the rotatable body, sleeved on the arm of the switching member and having fingers snapped in a groove defined in the arm.

2. The oscillating sprinkler of claim 1, wherein the push plate of the switching member is formed on its top with two bumps corresponding to the two slant cover plates of the rocker.

3. The oscillating sprinkler of claim 1, wherein the push plate of the switching member is formed at its edge an upright shield abutting against a side edge of the rocker.

4. The oscillating sprinkler of claim 1, further comprising:

a central tube extending through the inlet wall of the rotatable body;

a stationary gear wheel coaxially carried by the central tube;

a reduction gear train disposed in the rotatable body with a lower gear meshing with the stationary gear wheel and an upper gear meshing with a drive gear of the impeller; and the impeller being linked to the gear train such that the whole impeller housing and the rotatable body are able to oscillate about the stationary gear wheel carried by the central tube, through an angular displacement determined by the setting of the sweep setting rings;

wherein the impeller housing is formed at the bottom of the outlet wall with a half-cylindrical shell which has a radial wall provided with a receptacle coaxial to the drive gear of the impeller; and the drive gear of the impeller has a spindle with one end inserted in the receptacle of the radial wall of the shell.

5. The oscillating sprinkler of claim 4 further comprising an inlet portion defining therein an inlet conduit and a flow control valve; and the flow control valve being substantially embedded in the inlet portion for controlling flow of water through the inlet conduit and having an externally accessible portion for manual adjustment of the flow control valve.

* * * * *